United States Patent [19]

Max

[11] Patent Number: 5,033,241

[45] Date of Patent: Jul. 23, 1991

[54] PORTABLE FOLDING DANCE FLOOR

[76] Inventor: Teri Max, #12, Naples, Fla. 33962

[21] Appl. No.: 580,468

[22] Filed: Sep. 11, 1990

[51] Int. Cl.[5] ..... E04B 5/43; A63J 5/04

[52] U.S. Cl. ..... 52/71; 52/385; 52/390; 160/229.1

[58] Field of Search ..... 52/71, 385, 390, 586; 272/3; 160/229.1

[56] References Cited

U.S. PATENT DOCUMENTS 1,520,313 12/1924 Skinner ..... 428/50
2,102,086 12/1957 Mueller ..... 52/71
4,061,809 12/1977 Mautner ..... 428/50
4,682,459 7/1987 Stephenson ..... 52/390
4,698,249 10/1987 Brown ..... 52/385

*Primary Examiner*—Richard E. Chilcot, Jr.
*Assistant Examiner*—Kien T. Nguyen
*Attorney, Agent, or Firm*—William F. Hamrock

[57] ABSTRACT

The invention relates to a portable, foldable dance floor having a top surface of parquet panelling mounted on a flat plywood base, and composed of identical half-sections which open horizontally on a flat surface and close vertically parallel to each other.

8 Claims, 2 Drawing Sheets

PORTABLE FOLDING DANCE FLOOR

BACKGROUND OF THE INVENTION

1. Field of Invention

The invention relates to a portable dance floor, and in particular, to a small portable tap dance floor which produces the sound and feel of a hard wood stage floor when tap dancing thereon.

2. Description of the Prior Art

Tap dancing is becoming increasing popular for the young and old as a means of exercise and relaxation in addition to asserting one's tap dancing ability. Although tap dancers usually require only a small space to practice their steps, there are many problems associated with finding suitable means for such tap dancing practice. For instance, it would be advantageous that the dance floor be of such a structure and weight so that it can be carried to various locations by the dancer. Likewise, it would be desirable that the tap dance floor produce the sound similar to dancing on a hard wood floor such as a stage. It would also be desirable that the dance floor be able to transmit to the dancer the feeling of dancing on a hard wood tap dance floor. It would be helpful that the tap dance floor be able to absorb and cushion the vibrations and sound of the dancing to limit the intensity of the vibrations and noise from passing through to the underlying floor.

Various devices have been proposed in order to overcome these problems. However, applicant has no knowledge of any portable dance floor that satisfies the above needs.

Thus a need exists by tap dancers for a portable dance floor that produces the sound and transmits the feel of a hard wood tap dance floor, that is of such structure and weight that it can be adequately carried by the dancer, and that will absorb and cushion the vibrations and sound of the dancing.

SUMMARY OF THE INVENTION

It is an object of the present invention to provide a portable dance floor which is large enough to dance on and can be carried by the dancer to various locations.

It is another object to provide a portable dance floor which is able to produce the sound of dancing on a hard wood floor.

It is a further object of the invention to provide a portable dance floor which transmits to the dancer the feeling of dancing on a hard wood floor.

It is another further object of the invention to provide a dance floor which limits the intensity of the vibrations and sound of the dancing from passing through to the underlying floor.

The above objects are met with the present portable folding tap dance floor and solves many of the problems associated with prior art dance floors.

The portable folding tap dance floor of the invention includes hingedly attached half-sections. Each section has a top layer of parquet wood floor panels which are secured to a plywood base. The parquet panels may be square or rectangular or other shapes and of such thickness so as to satisfy the requirements of the invention. In a preferred embodiment, the plywood base includes holes of various sizes and locations cut through the plywood base. The holes reduce the weight of the dance floor and help to limit the intensity of the vibrations and sound resulting from dancing thereon. In another preferred embodiment, handles are attached to the sides of the structure for easy carrying of the dance floor.

DETAILED DESCRIPTION OF THE PREFERRED EMBODIMENT

Figure 1:
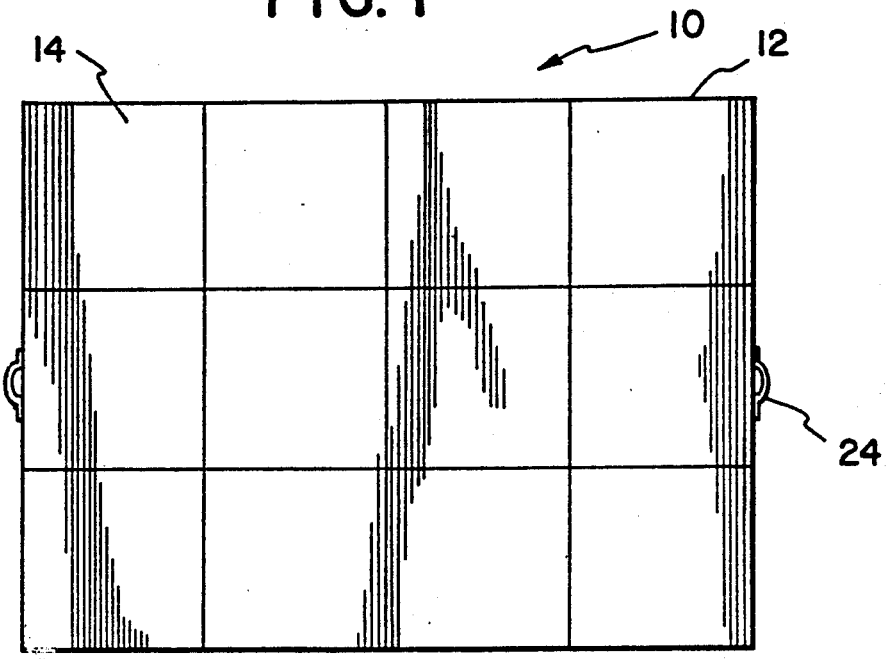
FIG. 1 is a top view of the dance floor open flat.
Figure 2:
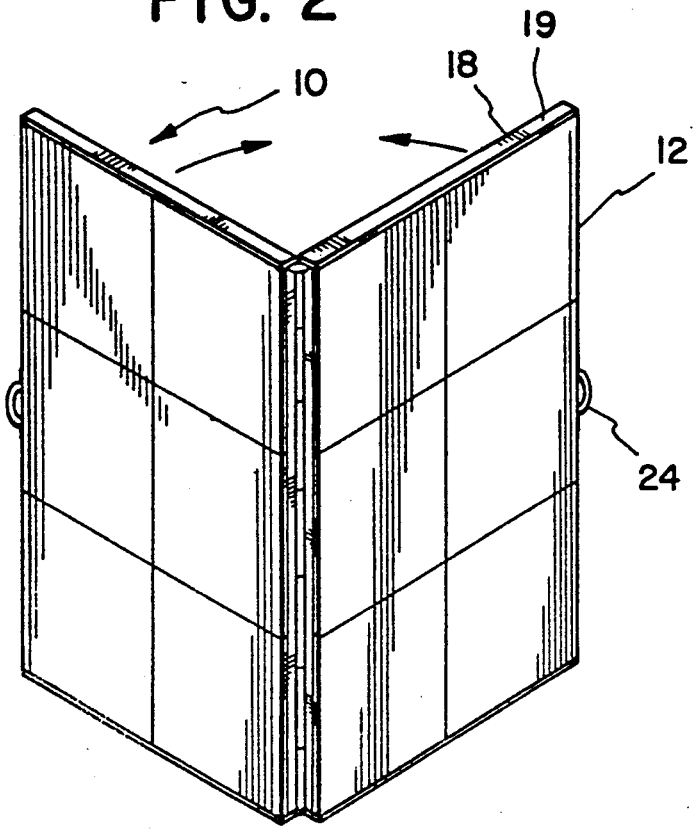
FIG. 2 is a sectional view of the dance floor in position to be closed.
Figure 4:
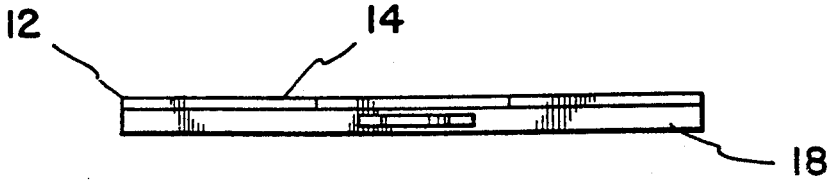
FIG. 4 is a side view of the parquet panels and plywood base.

FIGS. 1 and 2 illustrate an overall view of a preferred embodiment of the invention. There is shown a portable foldable dance floor 10 which is large enough to permit a dancer to carry out a tap dance routine. Preferably, the dance floor is being about four feet long by three feet wide. The dance floor contains two half-sections 12 containing a top layer of parquet panelling 14, preferably prepared from about twelve one foot by one foot square blocks 16 as shown. The parquet panels are secured to two sections of a base 18 preferably a plywood base with adhesive or other securement forming six squares on each section and twelve squares overall as shown. Preferably, base 18 is prepared from ½ inch to ¾ inch thick plywood and the parquet squares are about ¼ inch thick as seen in FIG. 4. There can be a framing 19 around the outer edge on the outer sides for a custom finish.

Figure 3:
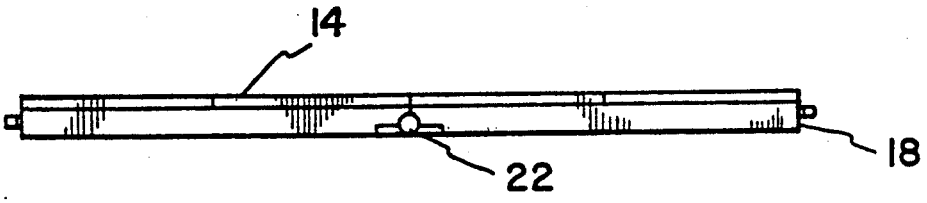
FIG. 3 is a end view of the plywood base having the hinges recessed therein.

The dance floor has a foldable structure as shown in FIG. 2. The two floor sections 12 are attached by hinges preferably piano hinges 22 as seen in FIG. 3, recessed into the abutting surfaces of plywood so that the dance floor is flat when opened on an underlying surface. Preferably each side of the abutting edges is routed to a depth of about ⅛ inch so that the piano hinge is flush with the floor.

Handles 24 are secured to the side edges of the dance floor as shown in FIGS. 1 and 2.

Figure 5:
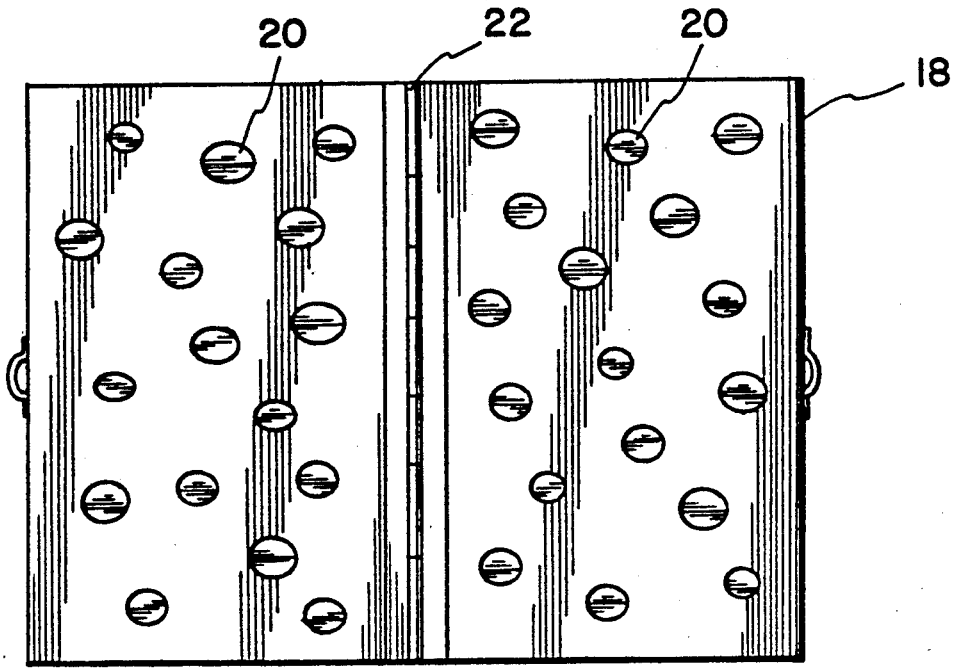
FIG. 5 is a bottom view showing the plywood base with intermittently spaced holes.

FIG. 5 depicts a preferred embodiment of the invention wherein holes 20 are cut into the plywood base 18. The holes are of different sizes and are intermittently spaced. It has been found that the holes not only reduce the weight of the dance floor but also help to limit the intensity of the vibrations and noise resulting from dancing thereon and from passing through to the underlying surface.

The entire structure is coated with a protective finish such as polyurethane varnish or similar coating.

There are several important features of the invention which makes it an unexpectedly unique device. It is light enough and small enough when folded to be carried about to various locations permitting the dancer to have it available at all times. It is large enough when opened flat to be completely suitable for tap dancing. It emits the sound of dancing on a hard wood floor and transmits that feeling to the dancer. It cushions the intensity of the vibrations and absorbs the sound of the dancing to prevent the same from being transmitted through the underlying surface which permits its use in various locations without disturbing others.

Further, it will be apparent to those skilled in the art from the foregoing description and accompanying drawings that additional modification and/or changes of the disclosed embodiments may be made without departure from the invention. Accordingly, it is expressly intended that the foregoing description and accompanying drawings are illustrative of preferred embodiments only, not limiting, and that the true spirit and scope of the present invention be determined by the reference to the appended claim.

What is claimed is:

1. A portable foldable tap dance floor comprising two flat half-sections, each of said half-sections having a top surface of parquet panelling mounted on a flat plywood base of about the same area, said plywood base having a plurality of holes of various sizes, each of said half-sections abutting one another at a side edge, means for hingedly attaching said half-sections along said abutting edges, whereby said half-sections open horizontally to form a flat surface suitable for tap dancing and close vertically parallel to each other when not in use.

2. A portable foldable tap dance floor according to claim 1 wherein said parquet panelling includes thin parquet blocks.

3. A portable foldable tap dance floor according to claim 2 wherein said blocks are about one foot square by about ¼ inch thick.

4. A portable dance floor according to claim 3 wherein each half-section has 6 blocks and is about three feet long at the abutting edges and about two feet wide.

5. A portable dance floor according to claim 1 wherein at least one handle is attached to a side of said dance floor.

6. A portable dance floor according to claim 4 wherein one handle is attached to each of the opposed edges opposite to said abutting edges.

7. A portable dance floor according to claim 1 wherein said means for attaching the half-sections includes hinges recessed into the abutting edges.

8. A portable dance floor according to claim 7 wherein said hinges are piano hinges.

* * * * *